US007125300B1

(12) United States Patent
Peterson

(10) Patent No.: US 7,125,300 B1
(45) Date of Patent: Oct. 24, 2006

(54) RECREATIONAL AQUATIC AIRBORNE VEHICLE

(75) Inventor: Leroy L. Peterson, Omaha, NE (US)

(73) Assignee: Sportsstuff, Inc., Omaha, NE (US)

( * ) Notice: Subject to any disclaimer, the term of this patent is extended or adjusted under 35 U.S.C. 154(b) by 0 days.

(21) Appl. No.: 11/348,065

(22) Filed: Feb. 6, 2006

(51) Int. Cl.
*B63B 1/00* (2006.01)
*B63B 21/56* (2006.01)

(52) U.S. Cl. ..... 441/65; 114/242

(58) Field of Classification Search ..... 441/65, 441/66, 74, 78, 136; 114/242, 253
See application file for complete search history.

(56) References Cited

U.S. PATENT DOCUMENTS 5,122,086 A * 6/1992 Remy ..... 441/66
5,564,357 A * 10/1996 Peterson ..... 114/345
D485,593 S * 1/2004 Muci ..... D21/803

FOREIGN PATENT DOCUMENTS

FR 2612078 A1 * 9/1988

* cited by examiner

*Primary Examiner*—Jesús D. Sotelo
(74) *Attorney, Agent, or Firm*—Sturm & Fix LLP

(57) ABSTRACT

The present invention provides a towable aquatic airborne vehicle having an inflated base ring with a top sheet and a bottom sheet attached to the top and bottom sides of the ring to form a non-inflated closed chamber. A cockpit section extends in from te interior side of the back end of the base ring and includes a pair of spaced foot troughs that receive the rider's feet, and a number of handgrips are attached adjacent the cockpit. Transparent window sections are located in the top and bottom sheets adjacent the front end of the base ring. When towed at high speeds, the front end of the vehicle rises up and the entire vehicle becomes airborne with the rider gripping the handgrips and looking ahead through the window sections.

27 Claims, 4 Drawing Sheets

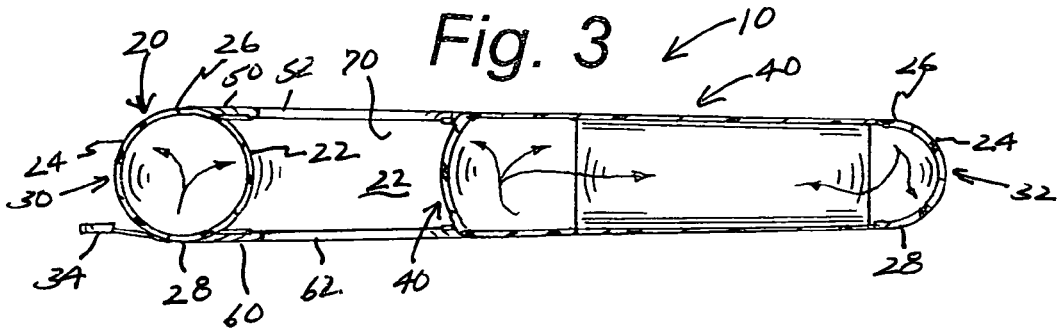
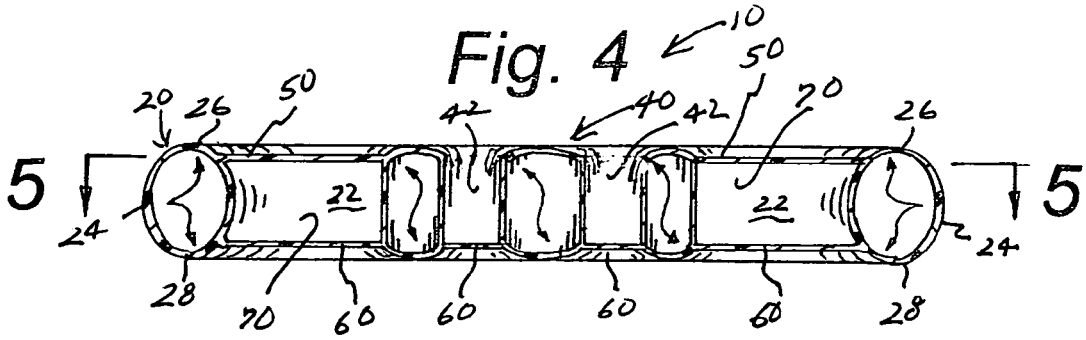
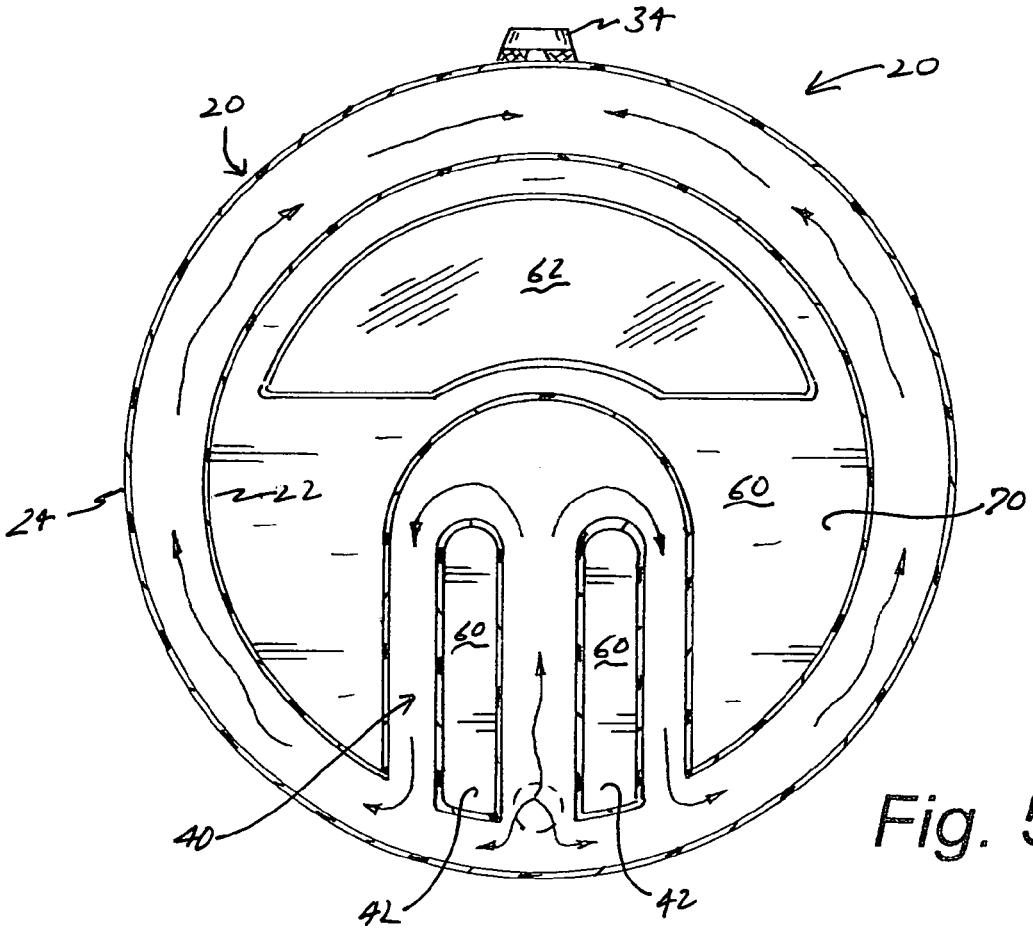
Fig. 5

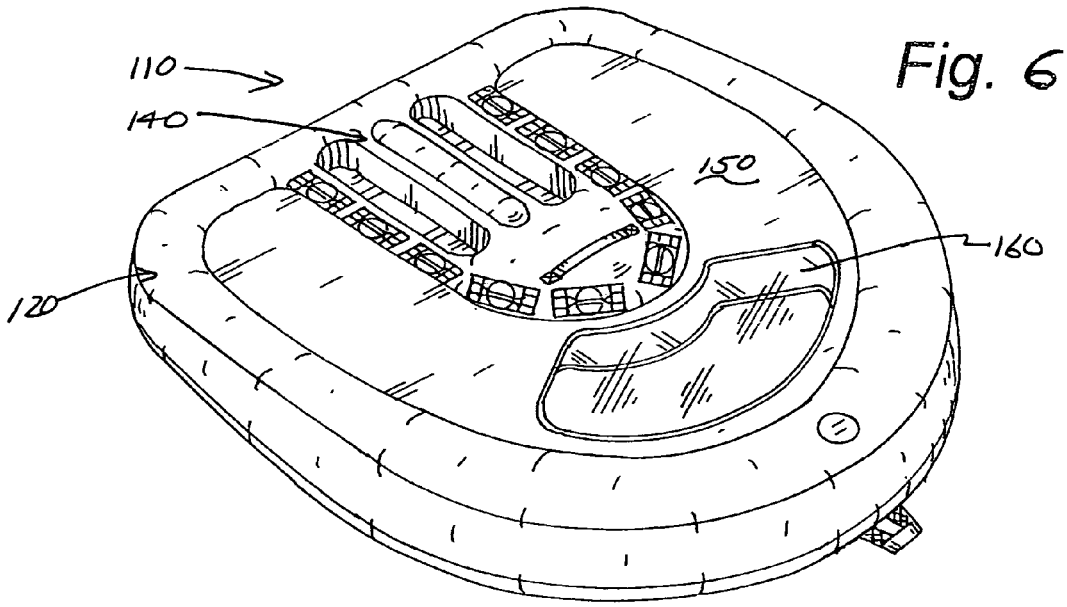
Fig. 6
Fig. 7
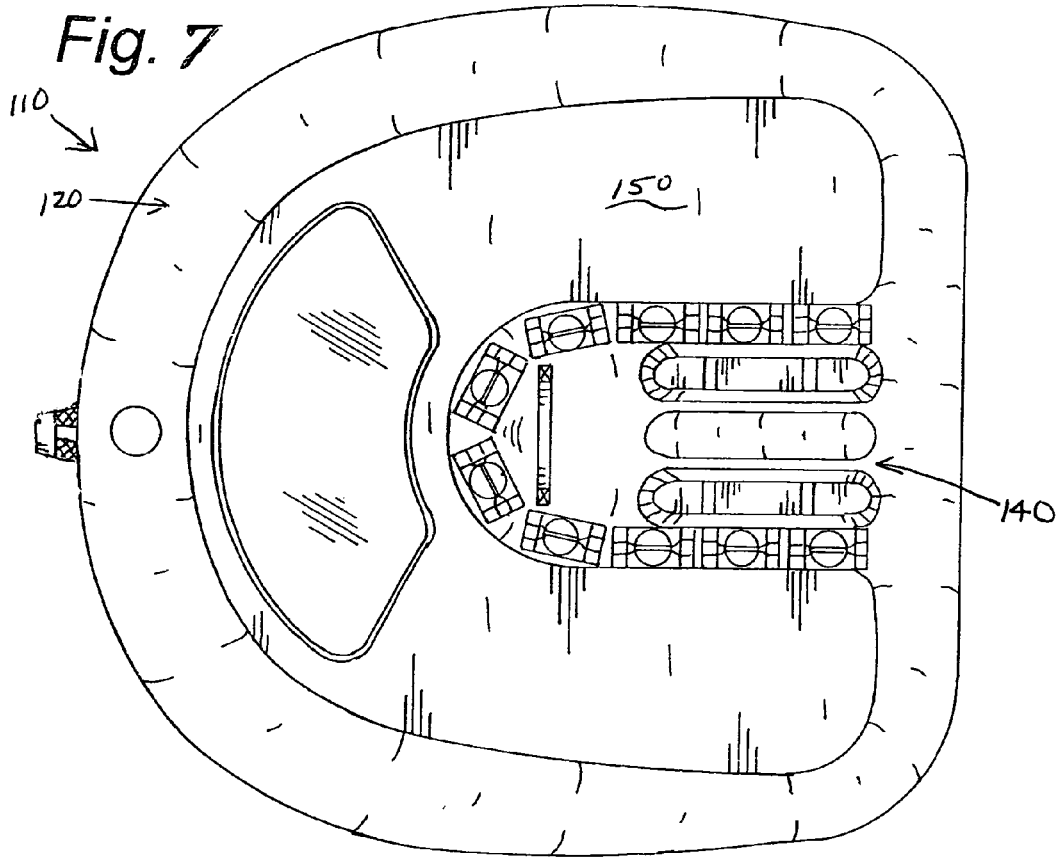

RECREATIONAL AQUATIC AIRBORNE VEHICLE

BACKGROUND OF THE INVENTION

1. Field of the Invention

The present invention relates to the field of recreational vehicles, and more particularly to a recreational aquatic vehicle that becomes airborne when towed at high speeds.

2. Description of Related Art

Recreational aquatic vehicles having sufficient exposed surface area are known to raise up out of the water and become airborne when towed at high speeds. However, the length of time the vehicle is airborne is generally very short, and the stability of the vehicle while in flight is very poor. The vehicles are uniformly deficient with respect to their failure to provide a simple, efficient, and practical structure that remains stabilized and airborne for extended periods of time.

As a consequence of the foregoing situation, there has existed a longstanding need among for a new and improved aquatic airborne vehicle, and the provision of such a construction is a stated objective of the present invention.

BRIEF SUMMARY OF THE INVENTION

Briefly stated, the present invention provides a towable aquatic airborne vehicle having an inflated base ring with a top sheet and a bottom sheet attached to the top and bottom sides of the ring to form a non-inflated closed chamber. A cockpit section extends in from te interior side of the back end of the base ring and includes a pair of spaced foot troughs that receive the rider's feet, and a number of handgrips are attached adjacent the cockpit. Transparent window sections are located in the top and bottom sheets adjacent the front end of the base ring. When towed at high speeds, the front end of the vehicle rises up and the entire vehicle becomes airborne with the rider gripping the handgrips and looking ahead through the window sections.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein:

FIG. 3 is a side elevation sectional view taken along line 3—3 of FIG. 2;

FIG. 4 is a rear elevation sectional view taken along line 4—4 of FIG. 2;

FIG. 5 is a top plan sectional view taken along line 5—5 of FIG. 4;

FIG. 6 is a perspective view of a first alternate embodiment of the vehicle;

FIG. 7 is a top plan view thereof;

DETAILED DESCRIPTION OF THE INVENTION

Figure 1:
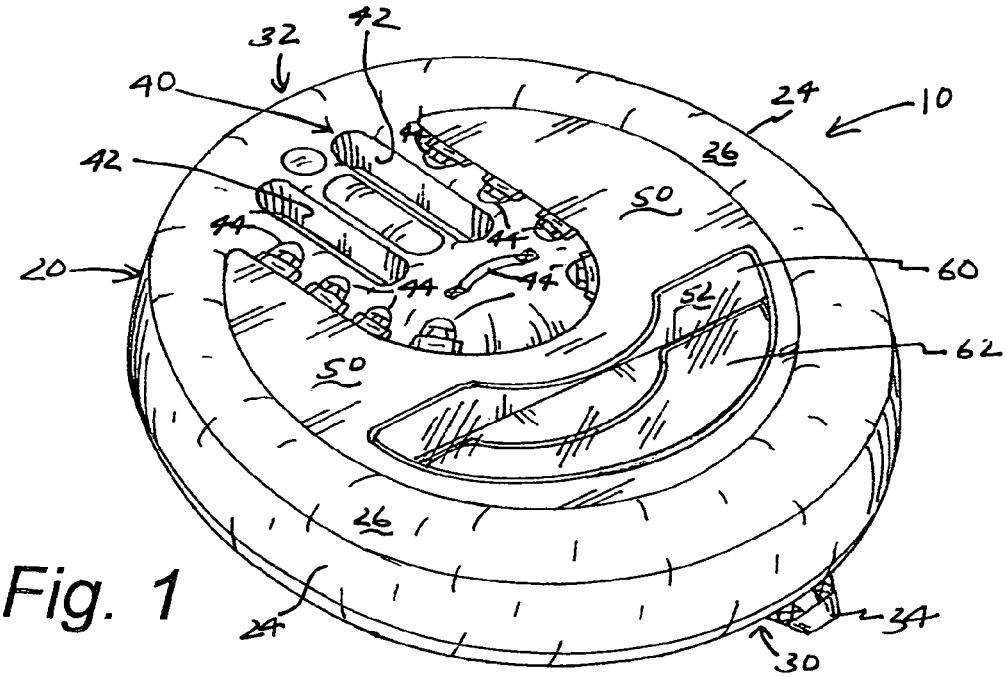
FIG. 1 is a perspective view of the towable aquatic airborne vehicle of the present invention.
Figure 2:
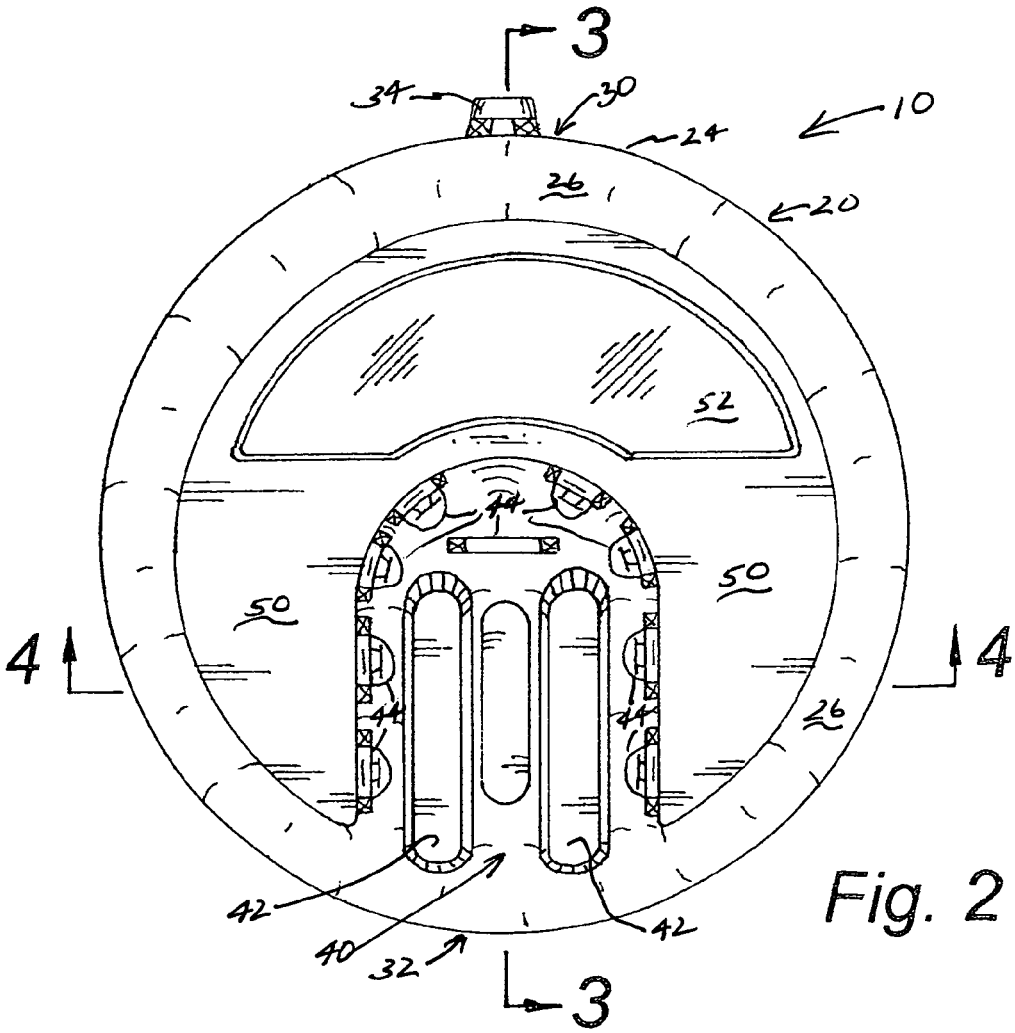
FIG. 2 is a top plan view thereof.

As can be seen by reference to the drawings, and in particular to FIG. 1, the aquatic airborne vehicle that forms the basis of the present invention is designated generally by the reference number 10.

The vehicle 10 includes an inflated circular base ring 20, an inflated cockpit section 40, and top and bottom sheets 50 and 60. As best shown by reference to FIG. 3, the base ring 20 has an interior side 22, and exterior side 24, a top side 26, a bottom side 28, a front end 30, and a back end 32. The cross sectional area of the ring 20 at the front end 30 is larger than the cross sectional area of the ring at the back end 32. A towing strap 34 is attached to the vehicle 10 adjacent the bottom side 28 of the ring 20 at the front end 30.

The cockpit 40 extends in from the interior side 22 of the base ring 20 at the back end 32. The cockpit 40 is formed as an inflated M-shaped member with a pair of spaced foot troughs 42 for receiving the rider's feet. A number of handgrips 44 are spaced around the edge of the cockpit 40.

The top sheet 50 is sealed to the top side 26 of the ring 20 and includes a transparent window section 52 located forward of the cockpit 40 adjacent the front end 30 of the ring 20. The bottom sheet 60 is sealed to the bottom side 28 of the ring 20 and includes a window section 62 that is disposed to register with the window section 52 in the top sheet 50. The space between the top sheet 50 and bottom sheet 60 forms a non-inflated closed chamber 70.

FIGS. 6 and 7 illustrate a first alternate embodiment vehicle 110 where the base ring 120 is D-shaped. The vehicle 110 is otherwise similar to the vehicle 10 and includes a cockpit 140 and top and bottom sheets 150 and 160.

Figure 8:
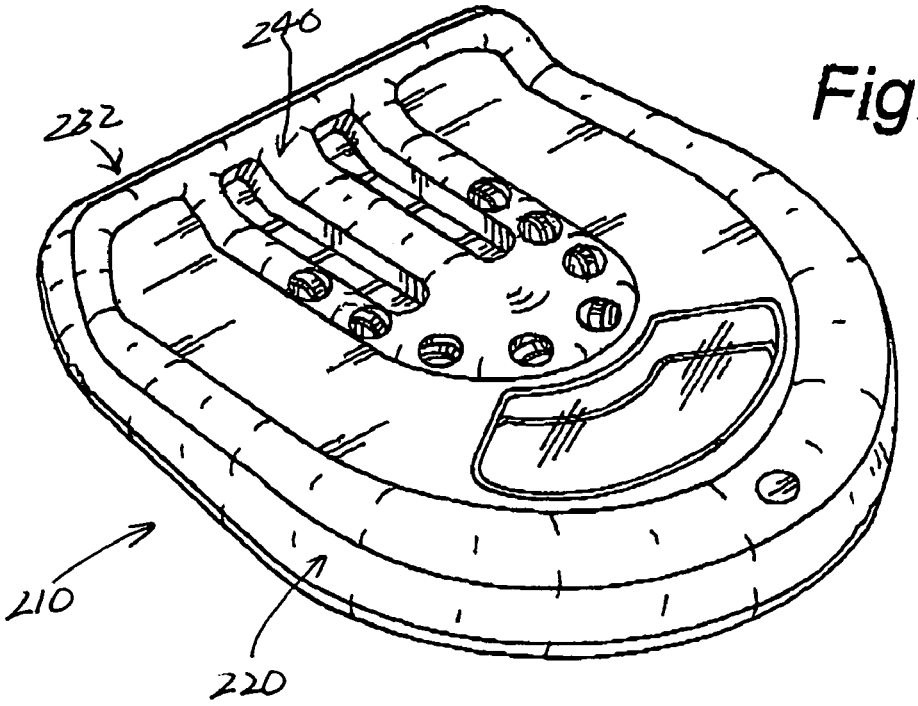
FIG. 8 is a perspective view of a second alternate embodiment of the vehicle.
Figure 9:
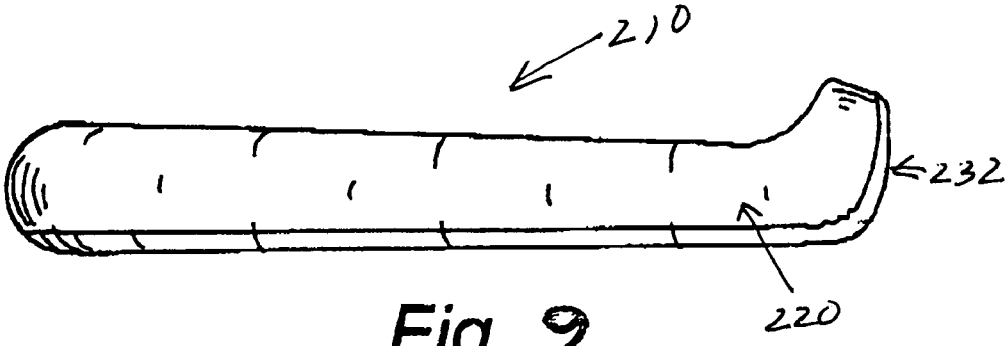
FIG. 9 is a left side elevational view thereof.

FIGS. 8 and 9 illustrate a second alternate embodiment vehicle 210 where the base ring 220 is also generally D-shaped, but where the back end 232 is flared up from the cockpit section 240.

Referring back to FIGS. 3–5, it can be seen from the flow arrows that the base ring 20 and the cockpit 40 are both inflated and are in fluid communication with each other so that only one inflation valve is required. Also, FIG. 5 shows that the bottom sheet 60 forms the bottom of the foot troughs 42.

In use, the vehicle 10 is attached to a towing boat by attachment of an appropriate tow line to the tow strap 34. The rider sits in the cockpit 40 with their feet and lower legs positioned in the foot troughs 42 while gripping selected handgrips 44. As the vehicle 10 picks up speed, the front end 30 rises up out of the water, the bottom sheet 60 is gradually exposed to the air, and the entire vehicle 10 becomes airborne. The rider is then in a substantially standing position leaning forward and exerting force on the handgrip to control the flight of the vehicle while looking forward through the window sections.

Previous designs of aquatic airborne vehicles that were tested using only a bottom sheet 60 were relatively unstable and did not stay airborne for extended periods of time. The addition of the top sheet 50 to form the closed chamber 70 improved the stability dramatically and allowed the vehicle 10 to remain airborne for long periods. It is believed that the addition of the top sheet 50 reduced the drag and made the vehicle more aerodynamically stable.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A towable aquatic airborne vehicle, comprising:

an inflated base ring having an interior side, an exterior side, a top side, a bottom side, a front end, and a back end;

a top sheet attached to the top side of the base ring and disposed to extend across the base ring;

a bottom sheet attached to the bottom side of the base ring and disposed to extend across the base ring;

wherein the top sheet, the bottom sheet, and the interior side of the base ring form a closed chamber; and a cockpit section extending inwardly from the interior side of the base ring at the back end of the base ring, wherein the cockpit section includes a pair of spaced foot troughs extending forward from the back end of the base ring.

2. The vehicle of claim 1 wherein the closed chamber is non-inflated.

3. The vehicle of claim 1, wherein a plurality of spaced handgrips are attached adjacent the cockpit section.

4. The vehicle of claim 3 further including a transparent window section located in each of the top and bottom sheets adjacent the front end of the base ring.

5. The vehicle of claim 3 wherein the base ring is circular.

6. The vehicle of claim 1 further including a transparent window section located in each of the top and bottom sheets adjacent the front end of the base ring.

7. The vehicle of claim 6 wherein the base ring is circular.

8. The vehicle of claim 1 wherein the base ring is circular.

9. The vehicle of claim 8 wherein the front end of the base ring has a first cross sectional area, and the back end of the base ring has a second cross sectional area smaller than the first cross sectional area.

10. The vehicle of claim 1, wherein the base ring includes a linear portion disposed at the back end, and an arcuate portion disposed at the front end.

11. The vehicle of claim 10, wherein the back end is flared upwardly from the cockpit section.

12. The vehicle of claim 11 wherein the front end of the base ring has a first cross sectional area, and the back end of the base ring has a second cross sectional area smaller than the first cross sectional area.

13. The vehicle of claim 10 wherein the front end of the base ring has a first cross sectional area, and the back end of the base ring has a second cross sectional area smaller than the first cross sectional area.

14. A towable aquatic airborne vehicle, comprising:

an inflated base ring having an interior side, an exterior side, a top side, a bottom side, a front end, and a back end;

a top sheet attached to the top side of the base ring and disposed to extend across the base ring;

a bottom sheet attached to the bottom side of the base ring and disposed to extend across the base ring;

wherein the top sheet, the bottom sheet, and the interior side of the base ring form a closed chamber;

a cockpit section extending inwardly from the interior side of the base ring at the back end of the base ring; and a transparent window section located in each of the top and bottom sheets adjacent the front end of the base ring.

15. The vehicle of claim 14 wherein the closed chamber is non-inflated.

16. The vehicle of claim 14 wherein the cockpit section includes a pair of spaced foot troughs extending forward from the back end of the base ring.

17. The vehicle of claim 16 wherein the base ring is circular.

18. The vehicle of claim 16 wherein the base ring includes a linear portion disposed at the back end, and an arcuate portion disposed at the front end.

19. The vehicle of claim 14 wherein a plurality of spaced handgrips are attached adjacent the cockpit section.

20. The vehicle of claim 19 wherein the base ring is circular.

21. The vehicle of claim 19 wherein the base ring includes a linear portion disposed at the back end, and an arcuate portion disposed at the front end.

22. The vehicle of claim 14 wherein the base ring is circular.

23. The vehicle of claim 22 wherein the front end of the base ring has a first cross sectional area, and the back end of the base ring has a second cross sectional area smaller than the first cross sectional area.

24. The vehicle of claim 14 wherein the base ring includes a linear portion disposed at the back end, and an arcuate portion disposed at the front end.

25. The vehicle of claim 24, wherein the back end is flared upwardly from the cockpit section.

26. The vehicle of claim 24 wherein the front end of the base ring has a first cross sectional area, and the back end of the base ring has a second cross sectional area smaller than the first cross sectional area.

27. The vehicle of claim 24 wherein the front end of the base ring has a first cross sectional area, and the back end of the base ring has a second cross sectional area smaller than the first cross sectional area.

* * * * *